US006429824B2

(12) United States Patent
LaRochelle et al.

(10) Patent No.: US 6,429,824 B2
(45) Date of Patent: Aug. 6, 2002

(54) LOW PROFILE, BROADBAND, DUAL MODE, MODIFIED NOTCH ANTENNA

(75) Inventors: Donald G. LaRochelle, Tyngsboro, MA (US); Michael J. O'Brien, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 09/847,551

(22) Filed: May 2, 2001

Related U.S. Application Data

(60) Provisional application No. 60/201,219, filed on May 2, 2000.

(51) Int. Cl.[7] ..... H01Q 13/10
(52) U.S. Cl. ..... 343/767; 343/770
(58) Field of Search ..... 343/767, 770, 343/795; H01Q 1/38, 13/10, 13/18

(56) References Cited

U.S. PATENT DOCUMENTS 4,723,305 A 2/1988 Phillips et al.
4,804,965 A 2/1989 Roederer
4,809,009 A 2/1989 Grimes et al.
5,185,611 A 2/1993 Bitter, Jr.
5,325,105 A 6/1994 Cermignani et al.
5,786,792 A * 7/1998 Bellus et al. ..... 343/767
5,898,409 A 4/1999 Holzman
5,952,982 A 9/1999 Jorgenson et al.
5,959,591 A 9/1999 Aurand
6,025,812 A * 2/2000 Gabriel et al. ..... 343/767
H1877 H 10/2000 Van Etten et al.
H1913 H 11/2000 Vanetten et al.

* cited by examiner

*Primary Examiner*—Michael C. Wimer
(74) *Attorney, Agent, or Firm*—Scott J. Asmus; Vernon C. Maine; Maine & Asmus

(57) ABSTRACT

A low profile, broadband includes an active conductive edge having a shape which approximates a quadratic curve. Two identical elements may be used in an opposed manner to form signals across their respective active edges, and two pairs of opposed identical elements may be used in quadrature for handling circularly polarized signals with a high degree of polarization purity. The quadratic curvature of the elements can provide sufficient space to co-locate a second, smaller antenna within the same volume and aperture as the larger antenna. Applications include combinations of a wide variety of current communications systems.

18 Claims, 2 Drawing Sheets

LOW PROFILE, BROADBAND, DUAL MODE, MODIFIED NOTCH ANTENNA

RELATED APPLICATIONS

This application claims priority to U.S. Provisional patent application Ser. No. 60/201,219, filed May 2, 2000.

FIELD OF THE INVENTION

The present invention relates to notch antennas and, more specifically, to a notch antenna suitable for circularly polarized signals.

BACKGROUND OF THE INVENTION

Antennas for line-of-sight (LOS) communications applications, typically in the UHF or L-band frequency bands, often have differing gain, polarization and field of view (FOV) requirements. Applications such as satellite communications (SATCOM) also impose stringent limitations on antenna size, volume and weight. Ideally, antennas for these types of applications should have reasonable gain at the horizon while still providing good coverage throughout the remainder of the hemisphere.

Typical antennas of the prior art suitable for use in these applications generally require large cavities having absorbers behind the radiating elements and suffer from low gain because of a 3 dB signal loss to the cavity. Applications benefiting from better antennas (i.e., higher gain, smaller, lighter, etc.) include SATCOM, GPS, Joint Tactical Information Distribution System (JTIDS), cellular phone, Tactical Air Navigation (TACAN), IFF transponder and digital Personal Communications Systems (PCS). Further complicating matters is the fact that several of these systems are frequently co-located on vehicles and particularly airplanes, which further drives the need for aperture and volumetric efficiency. Also, circular polarization is generally required for SATCOM and GPS applications, and polarization purity is critical for communication applications utilizing frequency reuse by means of polarization diversity.

It is, therefore, an object of the invention to provide an antenna which is capable of both linear and circular polarization.

It is an additional object of the invention to provide such an antenna having high polarization purity for circularly polarized signals.

It is another object of the invention to provide a modified notch antenna capable of performing these objectives.

It is still another object of the invention to provide a modified notch antenna which is nestable within itself at a smaller size for simultaneously accessing a higher frequency band using the same aperture and volume.

SUMMARY OF THE INVENTION

The present invention features both a low profile, broadband antenna as well as a notch antenna with a unique signal feed. The broadband antenna includes an active conductive edge having a shape which approximates a quadratic curve. Two identical elements may be used in an opposed manner to form signals across their respective active edges, and two pairs of opposed identical elements may be used in quadrature for handling circularly polarized signals with a high degree of polarization purity. The quadratic curvature of the elements can provide sufficient space to co-locate a second, smaller antenna within the same volume and aperture as the larger antenna.

In another form, a notch antenna includes a slot formed between the active conductive element and ground, which slot is used for coupling signals through the antenna. This arrangement can be used in quadrature to provide circularly polarized signals with high polarization purity.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE DRAWINGS

The present application discloses a broadband, low profile, dual mode modified notch antenna as well as a unique slot feed arrangement for notch antennas in general.

Figure 1:
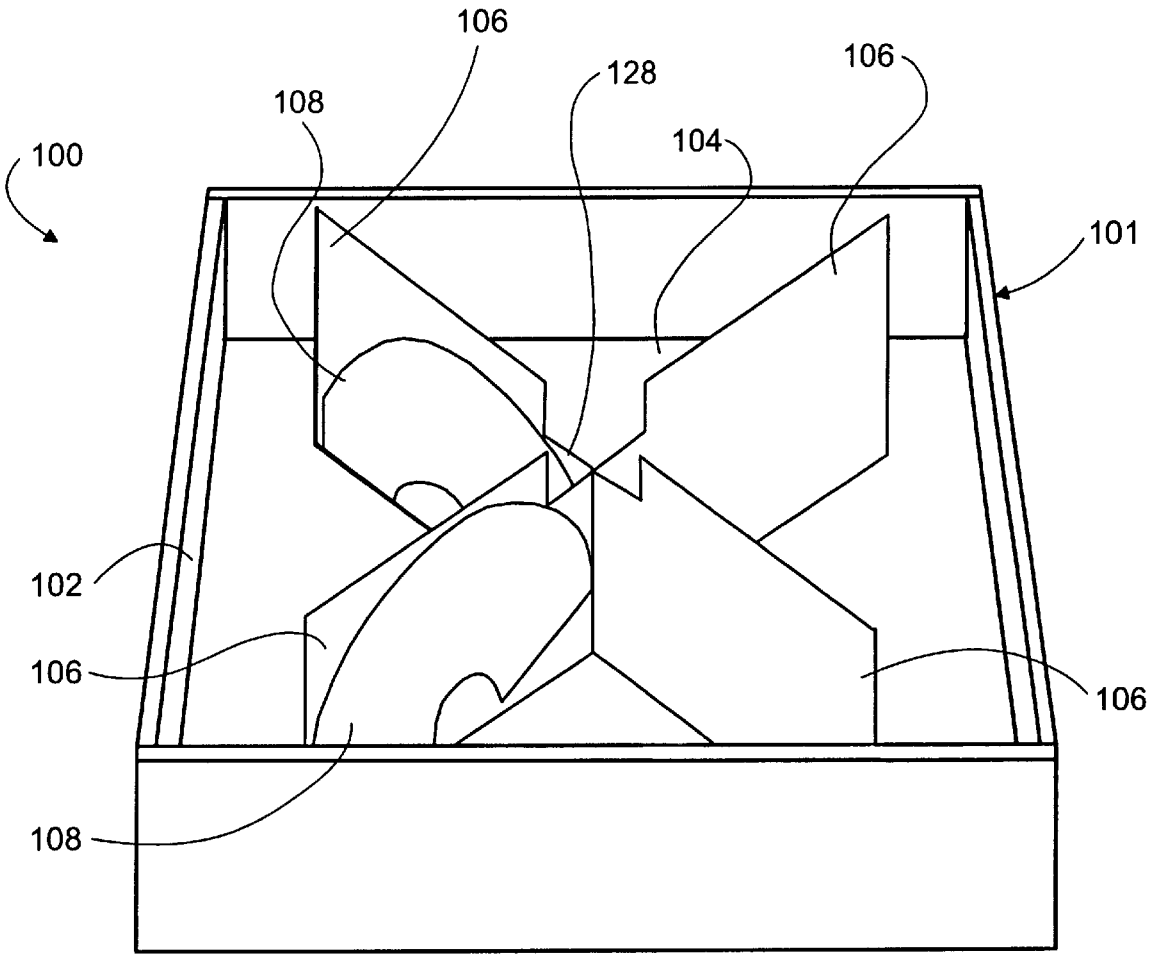
FIG. 1 is a perspective view of the low profile, broadband dual mode modified notch antenna constructed in accordance with one embodiment of the present invention.
Figure 2:
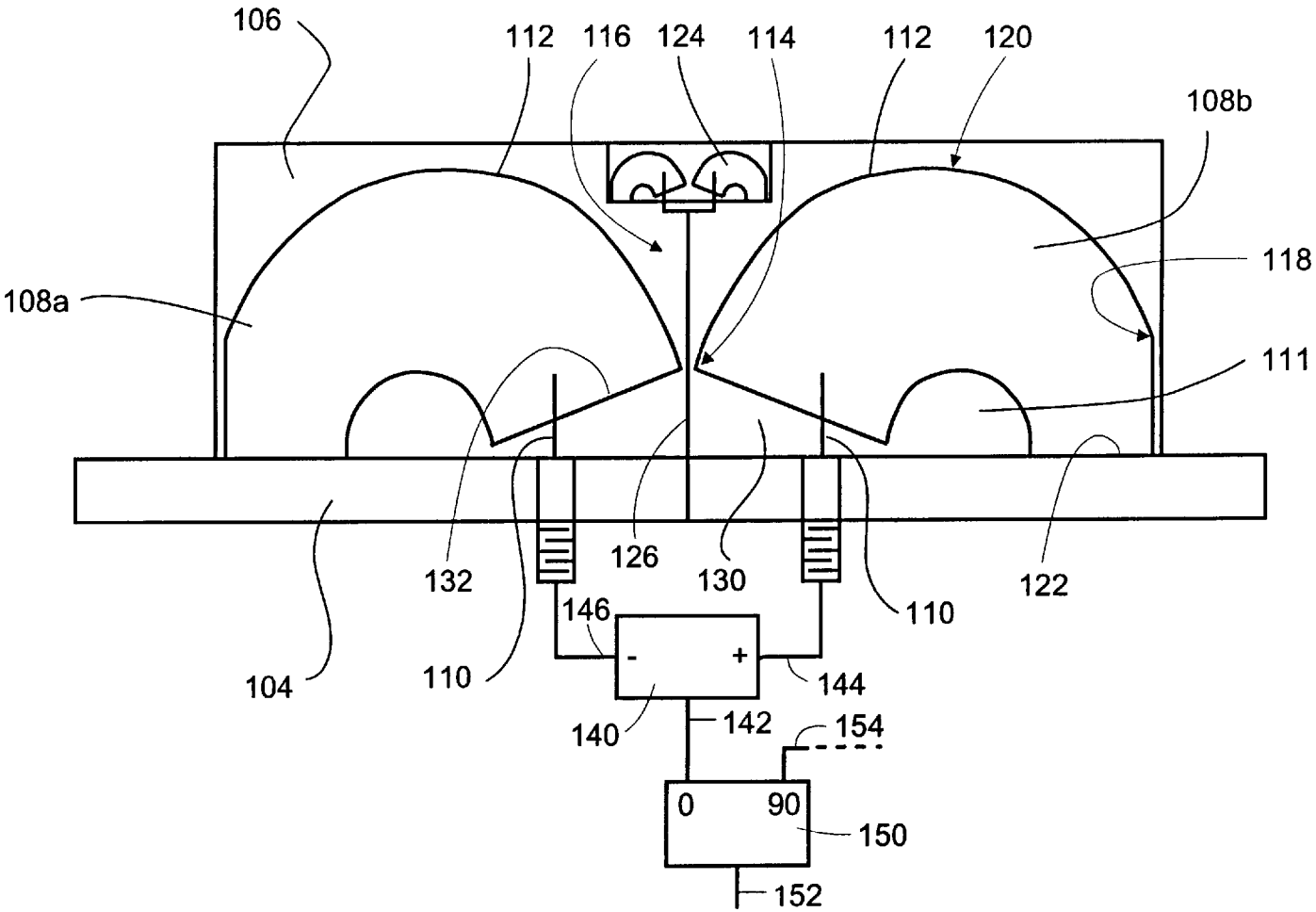
FIG. 2 is a side view of an antenna constructed in accordance with another embodiment of the present invention.

FIGS. 1 and 2 are referred to herein simultaneously unless otherwise specified. Identical and mirror components appearing in both figures bear the same reference numbers, and any singular description of such components herein is intended to refer to all such identical and mirrored components unless otherwise specified.

FIG. 1 shows an entire notch antenna 100 located in a cavity, including a ground plane 104 and four identical members 106 oriented orthogonally with respect to each other and with respect to ground plane 104. A cavity enclosure 101 surrounds antenna 100 including four identical walls 102. Each of the members 106 includes a conductive element 108 formed thereon.

Conductive elements 108 form the active elements of the antenna. They are each fed with a separate coaxial feed 110, which extends through the ground plane 104. Each conductive element 108 includes an active edge 112, which is operative in combination with another conductor to radiate and receive electromagnetic signals. In one embodiment of the inventions described herein the active edges 112 have a shape which approximates a quadratic curve. The active edges start from a point 114 and extend away from the ground plane 104. As shown in FIG. 2, a pair of opposed conductive elements 108 have the starting points 114 of their active edges 108 located proximally to each other, and from there the active edges 112 extend away from each other and away from ground plane 104. These opposed active edges 112 collectively form the active notch 116 of the antenna.

The curvature of active edges 114, and even of one edge alone, provides antenna 100 with its bandwidth, such that, in one mode of operation, electromagnetic signals are launched and received by the notch 116 at a position along the active edge 112 which is a function of the wavelength of the particular signal. This holds true as the wavelength increases and the distance between corresponding points of the active edges grows larger.

As mentioned, the shape of active edges 112, approximates a quadratic curve, such as a circle. This higher power of curvature provides a great deal of separation between corresponding points of the active edges 112 and thus a higher degree of bandwidth. Quadratic curves also curve back on themselves as shown, such that the active edges 112 actually extend back towards the ground plane 104 as they approach their respective distal points 118. In this manner the present notch antenna provides the aforesaid high degree of bandwidth, without the necessity for a correspondingly larger height profile for the antenna. Thus the bandwidth is extended by some fraction thereof from the highest point 120 of active edge 112 without any increase in the height profile of the antenna 100. It should be noted that the active edge 112 does not have to be constrained by the distal end 118 as shown, but may in fact extend to the ground plane. Conductive elements 108 are connected to ground plane 104 along the horizontal edge 122 thereof.

As a further benefit of the quadratic curvature of active edges 112, the large amount of spacing provided between opposed edges is sufficient to allow location of a second, smaller antenna 124, therebetween. FIG. 2 shows antenna 124 as a smaller version of the antenna 100, however, any suitable antenna may be used. It is only necessary that antenna 124 be sufficiently smaller so that dimensions thereof do not interfere with signals of the shortest wavelength of operation of antenna 100. Antenna 124 is shown with a signal feed 126 passing up through the center of antenna 100. Because the feed 126 is positioned perpendicular to the E and H fields generated between conductive elements 108, it does not interfere with those signals. FIG. 1 simply shows a notch 128 formed in members 106 where the antenna 124 can be located.

Conductive elements 108 are used in opposed pairs 108*a*, 108*b* as indicated in FIG. 2, so that their active edges 112 are opposed for forming or capturing transmission signals therebetween, and their respective starting points 114 are proximally located. As mentioned, members 106 of FIG. 1 are arranged orthogonally to each other such that two pairs of opposed conductive elements 108 are formed, with the two pairs being orthogonal to each other. In this manner, the two pairs may be fed with quadrature signals for the purpose of producing circularly polarized signals. These circularly polarized signals are first formed between the opposed conductive elements 108 at the starting points 114 of the active edges 112. For this reason, these starting points are located proximally to each other and may be referred to as proximal points. Proximal or starting points 114 are also all located equidistant from ground plane 104, as are corresponding points on the identical, opposed active edges 112.

Conductive elements 108 also include a unique feed arrangement in the form of slots 130. Each conductive element 108 includes an edge 132, which begins at the respective starting point 114 and extends along ground plane 104. Edge 132 forms an angle with ground plane 104 which thereby tapers slot 130 with an increasing dimension between the feed 110 and starting point 114. This taper provides an increasing impedance for signals created across slot 130 as they travel towards starting point 114. Likewise, slot 130 continues its diminishing taper until it reaches a broadband slot termination 111, which provides a matching terminal impedance. The use of such slots 130 is considered to be unique and particularly for providing signals to notch antennas as shown.

A particularly useful combination of the aforesaid elements is the use of slots for feeding signals to a quadrature notch antenna. This combination allows accurate phase alignment of circularly polarized signals, providing these signals with a high degree of polarization purity. Although the precise phase center will vary according to wavelength, it will be located along the center axis of antenna 100. The alignment of phase centers between the orthogonal pairs of elements is provided by the proximity of the proximal or starting points 114. Their equal distance to ground plane 104, which is part of the slots 130, contributes to the phase alignment of the quadrature signals.

As mentioned, the conductive elements 108 are formed on members 106, by any suitable means. In one form, members 106 are made of a dielectric material such as Duroid and conductive elements 108 are formed thereon by printed circuit techniques. Two opposing members 106 may also be formed from the same piece of dielectric material and the conductive elements 108 may be formed on the same side of that dielectric material as shown in FIG. 2, or they may be formed on opposing sides of that dielectric material as shown in FIG. 1.

The antennas of the present application may be energized in a variety of modes and orientations. These modes can vary between horizontal and vertical orientations because the antennas may be positioned either vertically or horizontally. Although the operational modes are described herein with respect to transmission signals the same modes of operation apply to received signals and may thus be referred to as modes of coupling signals through the antennas.

One mode of operation is the monopole mode, which may be created by driving conductive elements 108 equally and in phase with respect to ground plane 104. In this mode signals are launched and received at a point along the active edge which point is a function of the wavelength of the particular signal. Likewise, when all conductive elements 108 are arranged as shown in FIG. 1, coupling the same signal to each of the conductive elements causes them to all operate in the monopole mode with respect to ground plane 104. Vertical, as opposed to horizontal, orientation of ground plane 104 provides horizontally, as opposed to vertically, polarized signals.

A more significant mode of operation of the present antennas is provided by coupling signals across the feeds 110 of opposed conductive elements 108*a* and 108*b* of FIG. 2. For this purpose, a signal splitter 140 is shown to couple signals received on an input line 142 to a pair of out of phase output lines 144, 146, respectively. In this manner, input signals are provided between opposed conductive elements 108*a*, 108*b* for energizing notch 116. Signals introduced in this manner are first formed across their respective slots 130 with respect to ground and travel there-along to the proximal or starting points 114. At the proximal or starting points 114, these signals transition to the notch 116 and form an E field between active edges 112. These E fields then travel along the notch 116 until they transition to transmission signals at a point along active edges 112, which point is a function of the wavelength of the particular signal. This mode of operation of an opposed pair of conductive elements 108*a*, 108*b* is used to handle horizontally polarized signals when ground plane 104 is horizontally oriented and is alternatively used to handle vertically polarized signals when ground plane 104 is vertically oriented.

A further operating mode for the antennas is that of circular polarization. This mode is produced by coupling signals through the orthogonally oriented elements of FIG. 1. As described, the conductive elements 108 operate in opposed pairs in the same manner described above in reference to FIG. 2. Each of the opposed pairs is fed the quadrature signal of the other. For this purpose a quadrature splitter 150 is shown in FIG. 2 having an input 152 for receiving a transmission signal, a reference signal output connected to the input 142 of splitter 140 and a quadrature signal output 154 for coupling a quadrature version of the input signal to the second pair of opposed conductive elements 108. This second pair of opposed conductive elements 108 receives its quadrature signal in the same manner as elements 108*a,* 108*b,* through a respective spitter (not shown) which is identical to splitter 140. Under this arrangement the quadrature signals transition to their respective notches at the same point in space, thereby providing accurate phase alignment to both the E and H fields of the circularly polarized signal. This results in a circularly polarized signal with a high degree of polarization purity.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A broadband dual mode antenna, comprising:

a ground plane;

a first conductive element having a first active edge, wherein said first active edge has a shape which approximates a quadratic curve with a starting point and a distal end with said distal end coupled to said ground plane;

a second conductive element proximal and opposing said first conductive element and wherein said second conductive element and said first active edge operate in combination to transmit and receive electromagnetic signals, and;

a first slot feed arrangement, wherein said first conductive element has a tapered edge extending from said starting point of said active edge and forming an angle with said ground plane to form a slot therebetween, and further comprising a signal feed extending from said ground plane and across said slot to said tapered edge.

2. The broadband dual mode antenna according to claim 1, wherein said second conductive element has a second active edge, wherein said second active edge has a shape which approximates a quadratic curve with a starting point and a distal end with said distal end coupled to said ground plane, said second active edge defining a notch antenna in relation to said first active edge.

3. The broadband dual mode antenna according to claim 2, a second slot feed arrangement, wherein said second conductive element has a tapered edge extending from said starting point of said second active and forming an angle with said ground plane to form a slot therebetween, and further comprising a signal feed extending from said ground plane and across said slot to said tapered edge.

4. The broadband dual mode antenna according to claim 3, wherein said first and second conductive elements are substantially identical and approximately opposing each other with said respective starting points proximal each other.

5. The bradband dual mode antenna according to claim 3, and further comprising a second antenna located between said first and second active edge, wherein said second antenna has a separate signal feed positioned perpendicular to electromagnetic fields of said first and second conducting elements.

6. The broadband dual mode antenna according to claim 3, further comprising a third conductive element proximal and opposing a fourth conductive element, wherein said third and fourth conductive element are substantially identical to and orthogonal to said first and second conductive elements.

7. The broadband dual mode antenna according to claim 1, further comprising a cavity defined by conductive walls located around said conductive elements and perpendicular to said ground plane.

8. The broadband dual mode antenna according to claim 1, wherein said second conductive element is a ground plane and said first active edge of said first conductive element extends from said starting point and in a direction away from said second conductive element.

9. The broadband dual mode antenna according to claim 1, wherein said slot has a broadband impedance matched termination at an end of said tapered edge that is opposite said starting point.

10. The broadband dual mode antenna according to claim 1, wherein said first and second conductive elements are perpendicular to said ground plane.

11. The broadband dual mode antenna according to claim 6, wherein each respective signal feed is fed a quadrature signal of the other.

12. A notch antenna, comprising:

a ground plane;

a first pair of opposing conductive elements, each having an active edge and adapted to handle electromagnetic signals between their respective active edges, wherein said active edges of said first pair of conductive elements extend from a respective proximal point relative to each other and away from said ground plane, and wherein each said first pair of conductive elements includes a tapered edge extending from its respective proximal point and along said ground plane to form a slot therebetween;

a second pair of orthogonal conductive elements, each having an active edge and adapted to handle electromagnetic signals between their respective active edges, wherein said active edges of said second pair of conductive elements extend from a respective proximal point relative to each other and away from said ground plane, and wherein each second pair of conductive elements includes a tapered edge extending from its respective proximal point and along said ground plane to form a slot therebetween;

a separate signal feed for each of said first and second pair conductive elements extending from said ground plane and across each said respective slot to each said tapered edge; and wherein said first and said second pair of conductive elements have a coincident phase center for horizontal and vertical polarization.

13. The notch antenna according to claim 12, wherein each said respective slot includes a respective impedance matched termination, and further wherein each slot extends with a decreasing taper from its respective signal feed to its respective termination.

14. The notch antenna according to claim 12, wherein a transmission signal introduced across each said respective signal feed is injected into each said respective slot of the conductive elements and travels to said respective proximal point of each said conductive element, whereupon it transitions to a signal between each said respective active edges of the conductive elements.

15. The notch antenna according to claim 12, wherein a received transmission signal between said active edges are transitioned at said proximal point to said respective slot for handling as a received signal across said signal feeds.

16. The notch antenna according to claim 12, further comprising circuit means for handling quadrature signals between said first and second pairs of conductive elements, wherein circularly polarized signals are accurately transitioned at said proximal points.

17. The notch antenna of claim 12, wherein each of said active edges has a shape that approximates a quadratic curve.

18. The antenna of claim 12, wherein the active edges define a space therebetween, and further comprising a second antenna, said second antenna being located in said space defined between said active edges.

* * * * *

UNITED STATES PATENT AND TRADEMARK OFFICE

CERTIFICATE OF CORRECTION

PATENT NO. : 6,429,824 B2
DATED : August 6, 2002
INVENTOR(S) : LaRochelle et al.

It is certified that error appears in the above-identified patent and that said Letters Patent is hereby corrected as shown below:

Column 5,
Line 47, delete “active and forming”, insert -- active edge and forming --.
Line 56, delete “bradband”, insert -- broadband --.

Signed and Sealed this

Thirteenth Day of May, 2003

JAMES E. ROGAN
*Director of the United States Patent and Trademark Office*